US005110011A

United States Patent [19]

Laska et al.

[11] Patent Number: 5,110,011

[45] Date of Patent: May 5, 1992

[54] NON-RELEASABLE SPRAY HEAD AND DIP TUBE ASSEMBLY

[75] Inventors: Douglas J. Laska; W. Randolph Merton; Alan G. McKown, all of St. Paul, Minn.

[73] Assignee: Minnesota Mining and Manufacturing Company, St. Paul, Minn.

[21] Appl. No.: 546,109

[22] Filed: Jun. 29, 1990

[51] Int. Cl.[5] ..... B67D 5/00

[52] U.S. Cl. ..... 222/82; 222/90; 222/147; 222/630; 239/309; 239/346

[58] Field of Search ..... 222/81-82, 222/89, 90, 147, 464, 541, 567, 630, 637, 570; 215/14, 17, 29, 250, 253, 355; 220/307, 308, 277, 276, 265, 266, 268, 267, 278; 239/340, 346, 309; 285/313, 921

[56] References Cited

U.S. PATENT DOCUMENTS

| | | | |
|---|---|---|---|
| 2,090,977 | 8/1937 | Hoffman | 222/89 |
| 2,101,471 | 12/1937 | Greenbaum | 222/90 |
| 3,222,093 | 12/1965 | Simmons | 285/921 |
| 3,730,392 | 5/1973 | Marand | 222/82 |
| 4,220,285 | 9/1980 | Gualdi | 239/309 |
| 4,377,244 | 3/1983 | Rossetti | 220/268 |
| 4,653,676 | 3/1987 | Stull | 222/566 |
| 4,723,684 | 2/1988 | Lambert et al. | 220/268 |
| 4,767,058 | 8/1988 | LaRosa et al. | 239/309 |
| 4,804,144 | 2/1989 | Denman | 239/346 |
| 4,971,224 | 11/1990 | Scremin | 222/402.1 |
| 4,976,368 | 12/1990 | Klein | 220/268 |

*Primary Examiner*—Michael S. Huppert
*Assistant Examiner*—Philippe Derakeshami
*Attorney, Agent, or Firm*—Gary L. Griswold; Walter N. Kirn; James D. Christoff

[57] ABSTRACT

A disposable spray dispensing assembly for liquid materials includes a container comprising an aerosol can, and a spray head initially detached from the container. A cap closes an opening of the can and has a coined cover portion which may be ruptured by impact force to present a hole for reception of a dip tube of the spray head. A resilient, deflectable leg has a groove which locks with the cap when the dip tube is inserted into the container, and thereby provides a non-releasable coupling to secure the spray head to the container in captive fashion.

15 Claims, 3 Drawing Sheets

NON-RELEASABLE SPRAY HEAD AND DIP TUBE ASSEMBLY

BACKGROUND OF THE INVENTION

1. FIELD OF THE INVENTION

This invention relates to a disposable spray dispensing assembly adapted for detachable connection to a source of pressurized air for applying adhesives, coatings, sealants, solvents, penetrants, lubricants and the like.

2. DESCRIPTION OF THE RELATED ART

Air operated liquid spray dispenser assemblies typically include a spray head with a control valve, and a container releasably connected to the spray head. In preparation for use, the container is usually filled with liquid materials from a larger, bulk container, and the container is then coupled to the spray head which in turn is connected to an air hose. At the end of a spraying operation, the spray head is detached from the hose, and the container is detached from the spray head. Both the spray head and the container are then cleaned in preparation for the next spray operation.

Conventional spray heads have relatively small passageways, and thus are difficult to clean when used with certain liquid materials. In some instances, solvents may be used but are relatively expensive and somewhat hazardous. Moreover, such sprayers are not practical to use for liquids such as adhesives that cure and cannot be subsequently removed by solvents.

Recent developments in the art of air operated spray dispensers are described in U.S. Pat. Nos. 4,936,511 and 4,971,251, both of which are assigned to the assignee of the present invention. Such spray dispensers include a disposable, bag-like container that is non-releasably fixed to a spray nozzle assembly which, in turn, is adapted for detachable connection with a reusable air gun handle that includes a control valve. A rupturable barrier within the bag container prevents liquid materials from evaporating or leaking through the spray nozzle during transit. At the end of a work operation, the nozzle and attached bag container are removed from the handle and disposed, so that no cleaning is necessary.

However, shipping regulations in certain jurisdictions prevent or at least hinder shipping liquid materials in bag-like containers if the liquid materials include any solvents or flammable compositions. Moreover, there is a continuing interest in reducing the expenses associated with the spray nozzles and containers and the accompanying costs of filling the containers. As such, it is often prudent to consider the use of conventional liquid containers that are widely available and inexpensive to purchase and fill.

U.S. Pat. No. 4,804,144, dated Feb. 14, 1989, describes a spray dispenser apparatus that includes a disposable eductor assembly having a dip tube which extends into a screw top container. Both the eductor assembly and the container are detachably connected at separate locations to a tube structure which forms part of an air gun handle. Either the eductor assembly, the container, or both may be disconnected from the tube assembly for disposal when desired. The container includes an upper threaded tubular projection which is sealed by a disk having a scored center portion which may be punched out for passage of the dip tube.

However, the spray apparatus described in U.S. Pat. No. 4,804,144 is not entirely satisfactory when such a container is to be used as a shipping container and is labeled to identify the contents therein because of the possibility that the container may be refilled with another composition. In such circumstances, the container no longer correctly identifies the contents and may not sufficiently warn the operator of hazards associated with the contents (which is more of a potential problem if the apparatus is used by more than one person). Further, if the container is not sufficiently cleaned between uses, the new liquid contents may be contaminated or react with small amounts of the liquid materials originally packaged in the container.

SUMMARY OF THE INVENTION

The present invention relates to a spray dispensing assembly for liquid materials, and includes a container having a hole, a cover for initially closing the hole, and means for selectively opening the hole. The assembly also includes a spray head having an inlet with a connection for detachable joining with a source of pressurized air, and an outlet for discharging a spray of liquid materials. Advantageously, a non-releasable coupling selectively secures the spray head to the container and over the hole in captive fashion after the hole is opened, thereby substantially hindering refilling of the container.

At the end of a spraying operation, the container and spray head are removed as a single unit from the pressurized air source for simultaneous disposal. Thus, one can be assured that the label on the container in all likelihood correctly identifies the container's contents and that other materials have not been added to or substituted for the original contents.

DETAILED DESCRIPTION OF THE PREFERRED EMBODIMENT

Figure 1:
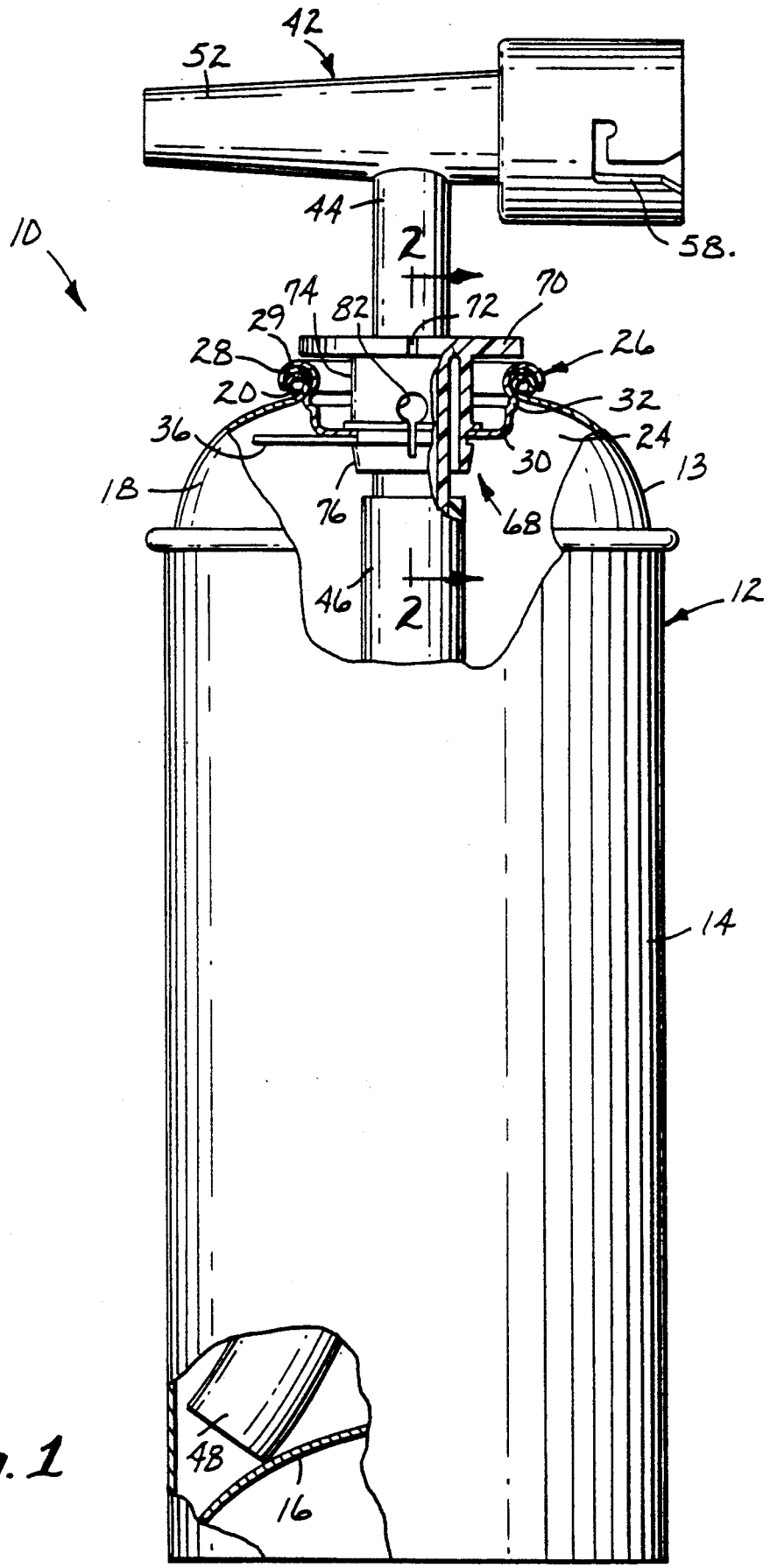
FIG. 1 is a side elevational view with parts broken away in section of a spray dispensing assembly constructed in accordance with the present invention.
Figure 2:
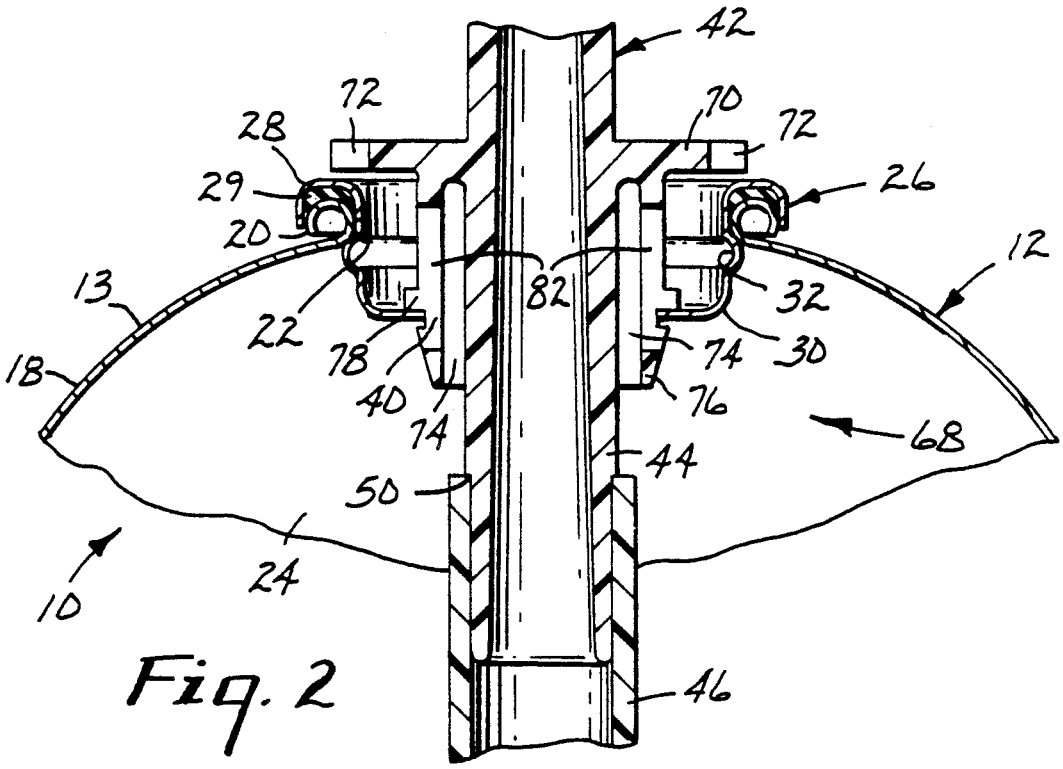
FIG. 2 is an enlarged, fragmentary, sectional view of the dispensing assembly shown in FIG. 1 taken along lines 2—2 of FIG. 1.

Referring initially to FIGS. 1 and 2, a spray dispensing assembly 10 of the present invention includes a container 12 that advantageously comprises an otherwise conventional, three piece aerosol can 13 widely available in the industry and manufactured of tin coated steel. The can 13 includes a cylindrical section 14 with a soldered side seam, a concave bottom 16 coupled in sealed relation to the section 14, and a domed top 18 that is seamed in leak-free relation to the section 14.

The top 18 has an upper rolled flange 20 which presents an opening 22 (FIG. 2) that communicates with an internal chamber 24 of the can 13. The opening 22, however, is covered by a novel captive cap 26 (see also FIGS. 5 and 6) that has an upper, peripheral rolled-over flange 28 that complementally rests atop the flange 20 of the top 18. A buna-N gasket 29, having a 70–80 durometer Shore A hardness, is placed within the flange 28 and is held in place by three dimples 31 (one of which is shown in FIG. 6) before assembly of the cap 26 to the can 13. The gasket 29 lies between the flanges 20, 28 as shown in FIGS. 1 and 2 to provide a seal between the can 13 and the cap 26 once the cap 26 and can 13 are assembled.

During assembly of the container 12, an expandable collet is placed within a recessed, central cup 30 of the cap 26, and the collet is then radially expanded to form a peripheral crimp 32 (FIGS. 1 and 2) in the cylindrical sidewall of the cap 26 immediately below the portion of the top 18 underlying the flange 20. The integral cap 26 is made of 0.0105 inch tin plated steel. The crimp 32 extends through the area where the dimples 31 were previously located, causing the dimples 31 to blend into the crimp 32 and effectively disappear.

Figure 5:
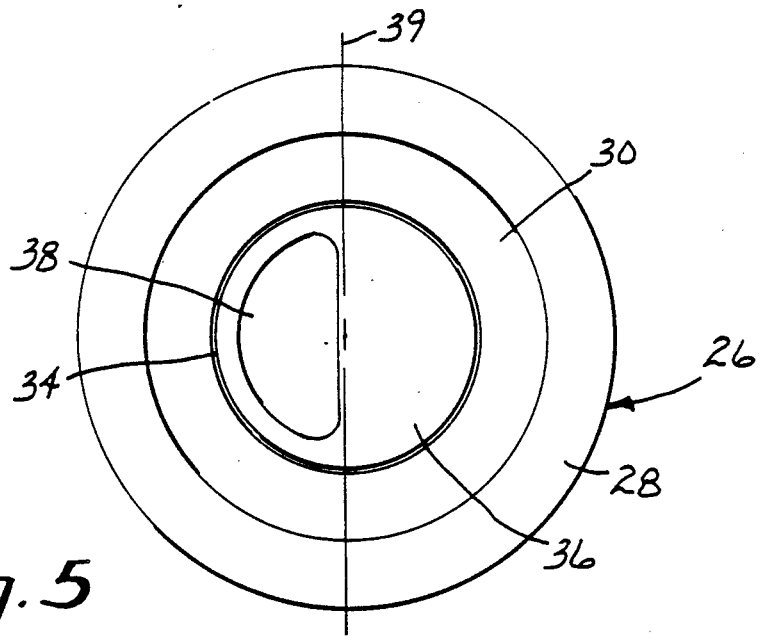
FIG. 5 is an enlarged plan view of a coined cap before assembly of the cap to a can of the assembly shown in FIGS. 1 and 2.
Figure 6:
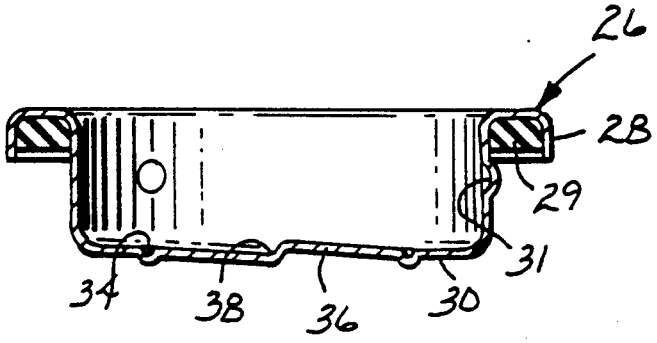
FIG. 6 is a side cross-sectional view of the cap shown in FIG. 5.
Figure 3:
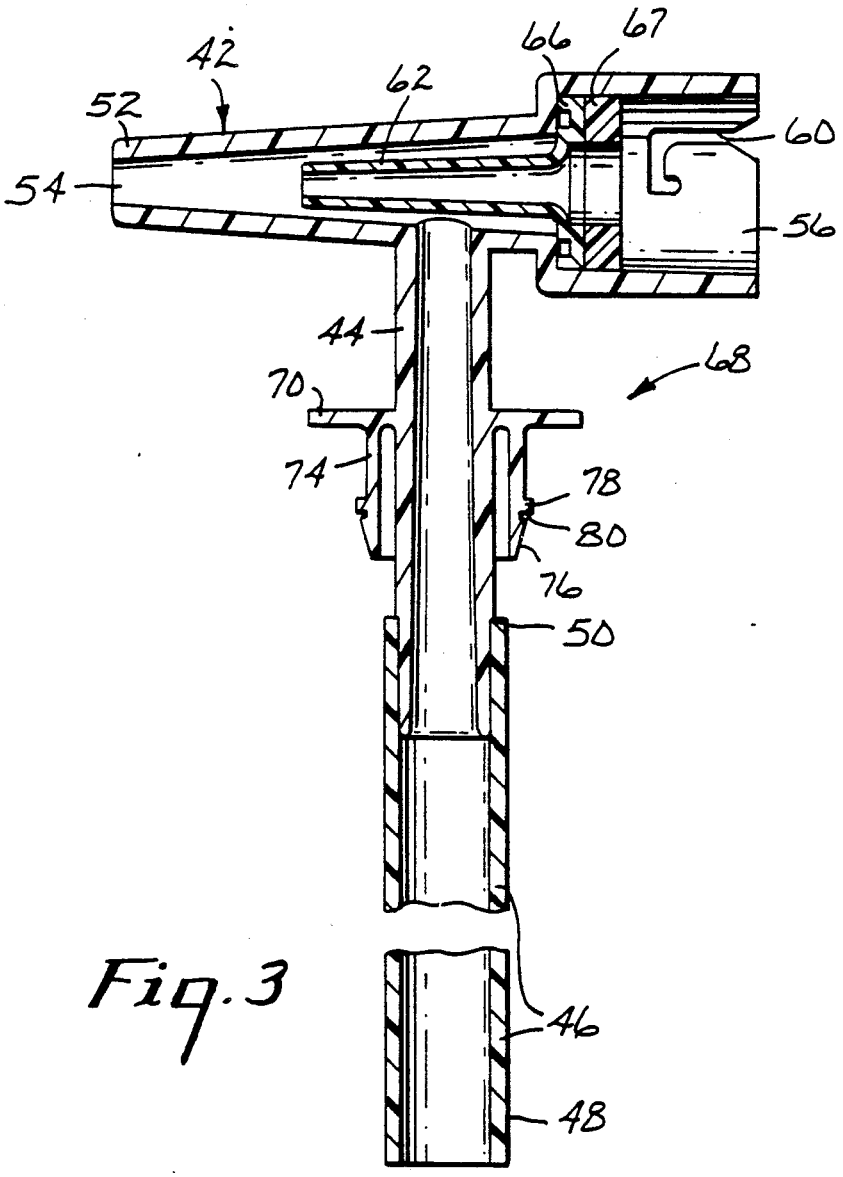
FIG. 3 is a sectional view of a spray head and non-releasable coupling of the assembly shown in FIGS. 1 and 2.
Figure 4:
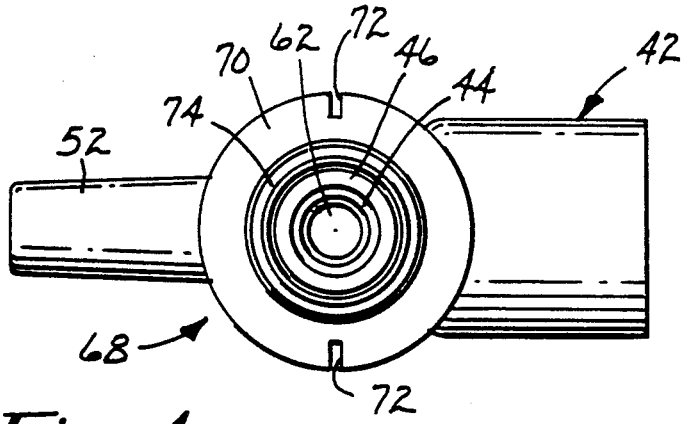
FIG. 4 is a plan view of the spray head depicted in FIG. 3.

As shown in FIGS. 5 and 6, the bottom of the cap 26 has a scored, circular line of weakness 34 that surrounds a cover or central cover portion 36 having a small recess 38 located on one side of a central reference axis 39 of the cover portion 36. When it is desired to open the container 12 for a spray dispensing operation, a screwdriver or similar tool is placed in the recess 38 and pressure is exerted toward the bottom 16 of the container 12 until the coined central cover portion 36 separates along a major extent of the line of weakness 34 from remaining portions of the cup 30 to thereby establish a hole 40 as shown, for example, in FIG. 2. As such, the line of weakness 34 comprises a means for selectively opening the hole 40 by permitting partial separation of the cover portion 36 from areas of the cap 26 adjacent the hole 40. Typically, the cover portion 36 is bent to an out-of-the-way orientation when the hole 40 is opened, but remains partially joined to the cap 26 in order to avoid interfering with liquids withdrawn through a dip tube 46.

Referring now to FIGS. 1–4, a spray head 42 has a depending, tubular body 44 that is connected in interference fit relation to an upper end of the dip tube 46. Preferably, the dip tube 46 is cut from roll stock of polyethylene tubing, and as such has an inherent slight curvature to enable a lower end 48 of the dip tube 46 to extend closely to the lower peripheral region of the chamber 24 as shown in FIG. 1. The body 44 is circumscribed with a shoulder 50 (FIGS. 2 and 3) to provide a positive stop to limit advancement of the dip tube 46 above the shoulder 50 when the dip tube 46 is assembled to the body 44. The spray head 42 has a nozzle portion 52 integrally connected to the top of the body 44, and the nozzle portion 52 narrows to an outlet 54 (FIG. 3) for discharging a spray of liquid materials. The spray head 42 also includes a tubular inlet 56 having a cylindrical sidewall with opposed J-shaped channel connections 58, 60 (FIGS. 1 and 3) for detachable coupling to a source of pressurized air. More particularly, the channel connections 58, 60 are adapted to receive respective, opposed pins of an air gun handle and thus provide a releasable bayonet or twist-lock coupling between the handle and the spray head 42. The gun handle includes a trigger valve for controlling the flow rate of pressurized air directed into the inlet 56, and a representative handle is described in the aforementioned U.S. Pat. No. 4,936,511.

A venturi nozzle insert 62 (FIG. 3) directs pressurized air from the inlet 56 toward the outlet 54 through a central passage, and the flow of air establishes negative pressure conditions in the tubular body 44 and the dip tube 46 to withdraw liquid materials from the chamber 24. The insert 62 has an endmost, annular flange 66 that is received in the inlet 56 and functions to retain remaining portions of the insert 62 in coaxial alignment and spaced apart from inner walls of the nozzle portion 52. A gasket 67 is adapted to sealingly engage the end of the detachable air gun handle.

A nonreleasable coupling 68 selectively secures the spray head 42 to the cap 26 of the container 12 and over the hole 40 in captive fashion after the hole 40 is opened. The coupling 68 is illustrated in FIGS. 1–4, and includes an annular wall 70 that is integral with the body 44. Two opposed notches 72 (FIGS. 2 and 4) are formed in an outer portion of the wall 70.

The coupling 68 includes a generally cylindrical, hollow, skirt-like leg 74 that integrally depends from the wall 70 and surrounds an upper portion of the body 44. A lower, outer surface 76 of the leg 74 is tapered and is separated from an annular, outwardly extending stop 78 of the leg 74 by a groove 80 (FIG. 3) that circumscribes the leg 74.

Opposite sides of the leg 74 each have a keyhole-shaped relief aperture 82 (FIGS. 1 and 2). The spray head 42 and the coupling 68 are integrally molded of polypropylene, and consequently the leg 74 is somewhat resilient. When the cover portion 36 is opened and the spray head 42 is lowered toward the cup 30 with the dip tube 46 extending through the hole 40, the tapered surface 76 upon engagement with the edge of the cap 26 surrounding the hole 40 will cause opposite side portions of the leg 74 to deflect inwardly until the edge of the cap 26 reaches the groove 80, whereupon the leg 74 will expand in radial fashion due to its inherent resiliency until the edge of the cap 26 surrounding the hole 40 is firmly seated and locked in place in the bottom of the groove 80 as shown in FIGS. 1 and 2. During insertion of the dip tube 46 and leg 74 into the chamber 24, the surface 76 engages the cover portion 36 and moves the latter to the orientation shown in FIG. 1 against cup 30. The stop 78 substantially prevents further advancement of the leg 74 toward the chamber 24.

The keyhole shape of the aperture 82 is advantageous in that the enlarged portion of the aperture 82 weakens a central portion of the leg 74 for facilitating inward deflection of the latter, while providing sufficient area for pressure relief as described hereinafter. The narrower lower slot-like region of the aperture 82 enables increased engagement of the cap 26 in the groove 80 to facilitate permanent, snap-fit locking attachment of the spray head 42 to the container 12 and yet also provides space for deflection of the leg 74. The lower slot-like region of the aperture 82 could be extended if desired to the lower end of the leg 74 to separate the latter into two spaced apart portions, but the leg 74 is somewhat stiffer when constructed as shown which increases the likelihood that the cap 26 will remain firmly seated in the bottom of the groove 80. The thickness of the groove 80 is approximately three times the thickness of the cup 30 in order to receive the portion of the cap 26 surrounding the hole 40 as well as the section of the cover portion 36 in the region of the line of weakness 34 that does not completely fracture when the cover portion 36 is opened and moved toward the domed top 18 and against the cup 30.

The wall 70 extends over the upper flange 28 of the cap 26 to hinder excessive rocking of the spray head 42 that might otherwise permit the cap 26 to disengage the groove 80 and thereby enable release of the leg 74 from the cap 26. The wall 70 also provides a shield to hinder insertion of a prying object such as a screwdriver toward the leg 74 during attempts to intentionally deflect the leg 74 inwardly to release the spray head 42 from the cap 26. Moreover, since the wall 70 is spaced closely adjacent the flange 28, the wall 70 cooperates with the stop 78 to prevent undue rocking or tilting of the spray head 42 when a lateral deflection is exerted on the latter in an attempt to separate the spray head 42 from the cap 26.

The combined free area of the apertures 82 is large enough to prevent substantial increase of pressure in the chamber 24 should the spray head outlet 54 or other regions of the nozzle portion 52 become clogged for any reason. Viewing FIG. 2, excessive pressure within the chamber 24 is relieved by venting the air through the annular space between the leg 74 and the body 44, and thence through the apertures 82 in areas above the groove 80. The air then flows through the small annular space between the wall 70 and the flange 28, or alternatively through the two notches 72. In such instances, the wall 70 serves as a shield to deflect liquid materials escaping the chamber 24 away from the user's face.

In ordinary use, the coupling 68 non-releasably couples the spray head 42 to the container 12 in captive fashion, and thereby prevents refilling of the chamber 24. It is realized, however, that under some circumstances it may be possible to exert such a substantial force on the coupling 68 (as may occur, for example, when the spray head 42 is excessively tilted and/or pulled) that the plastic coupling 68 may deform or fracture in areas adjacent the groove 80 sufficiently to enable the leg 74 to be released from the hole 40. In most circumstances, however, such intentional action would destroy the coupling 68 adjacent the groove 80 to such an extent that firm re-coupling of the groove 80 and the cap 26 would no longer be possible, and the spray head 42 in all likelihood would no longer remain attached in satisfactory fashion to the container 12 when the chamber 24 is pressurized for spraying.

We claim:

1. A spray dispensing assembly for liquid materials comprising:

a container having a hole, a cover for initially closing said hole, and means for selectively opening said hole;

a spray head having an inlet with a releasable connection for detachable joining with a source of pressurized air, an outlet for discharging a spray of liquid materials, a tubular body, and means for establishing negative pressure conditions in said tubular body upon passage of air from said inlet to said outlet; and a non-releasable coupling for selectively securing said spray head to said container and over said hole in captive fashion after said hole is opened, thereby substantially hindering refilling of said container.

2. The assembly of claim 1, wherein said coupling includes a leg for extension into said hole when said spray head is secured to said container.

3. The assembly of claim 2, wherein said leg includes a groove for snap-fit reception of said container adjacent said hole.

4. The assembly of claim 2, wherein said leg includes a tapered surface for facilitating insertion of said leg into said hole.

5. A spray dispensing assembly for liquid materials comprising:

a container having a hole, a cover for initially closing said hole, and means for selectively opening said hole;

a spray head having an inlet with a connection for detachable joining with a source of pressurized air, and an outlet for discharging a spray of liquid materials;

a non-releasable coupling for selectively securing said spray head to said container and over said hole in captive fashion after said hole is opened, thereby substantially hindering refilling of said container, wherein said coupling includes a leg for extension into said hole when said spray head is secured to said container; and a relief aperture adjacent said leg.

6. The assembly of claim 5, wherein said aperture includes an enlarged portion and an adjacent narrowed portion.

7. The assembly of claim 5, wherein said aperture is keyhole shaped.

8. The assembly of claim 2, wherein said leg has a generally cylindrical configuration.

9. A spray dispensing assembly for liquid materials comprising:

a container having a hole, a cover for initially closing said hole, and means for selectively opening said hole;

a spray head having an inlet with a connection for detachable joining with a source of pressurized air, and an outlet for discharging a spray of liquid materials; and a non-releasable coupling for selectively securing said spray head to said container and over said hole in captive fashion after said hole is opened, thereby substantially hindering refilling of said container, wherein said coupling includes a leg for extension into said hole when said spray head is secured to said container, wherein said coupling includes an outwardly extending wall adjacent said leg for hindering excessive tilting of said spray head when said spray head is secured to said container.

10. The assembly of claim 9, wherein said wall and said container are closely adjacent one another when said spray head is secured to said container in order to hinder access to said leg.

11. The assembly of claim 9, wherein said wall includes a pressure relief notch.

12. The assembly of claim 1, wherein said container has an opening and includes a captive cap non-releasably covering said opening, and wherein said cap includes said cover.

13. The assembly of claim 12, wherein said means for selectively opening said hole comprises a scored line of weakness in said cap.

14. The assembly of claim 13, wherein said container includes a top, and wherein said cap includes a crimp for securing said cap to said top.

15. The assembly of claim 1, wherein said spray head includes a dip tube for extension through said hole.

* * * * *